United States Patent [19]

Zolla

[11] 4,167,416

[45] Sep. 11, 1979

[54] COMPOSITION FOR THE ELECTROLESS DEPOSITION OF NICKEL BASE ALLOYS

[75] Inventor: Bruno Zolla, Pecetto, Italy

[73] Assignee: Alfachimici S.p.A., Turin, Italy

[21] Appl. No.: 831,300

[22] Filed: Sep. 7, 1977

[30] Foreign Application Priority Data

Oct. 19, 1976 [IT] Italy ..... 69510 A/76

[51] Int. Cl.[2] ..... C23C 3/02

[52] U.S. Cl. ..... 106/1.25; 106/1.27; 106/1.29; 427/430 A; 427/438

[58] Field of Search ..... 106/1.22, 1.23, 1.25, 106/1.27, 1.29; 427/430 A, 438

[56] References Cited

U.S. PATENT DOCUMENTS

| | | | |
|---|---|---|---|
| 3,295,999 | 1/1967 | Klein et al. | 106/1.22 |
| 3,485,597 | 12/1969 | Pearlstein | 106/1.12 |
| 3,915,716 | 10/1975 | Haack | 106/1.22 |
| 3,971,861 | 7/1976 | de Waltoff | 106/1.22 |
| 4,019,910 | 4/1977 | Mallory | 106/1.23 |
| 4,028,116 | 6/1977 | Cedarleaf | 106/1.22 |

*Primary Examiner*—Lorenzo B. Hayes

*Attorney, Agent, or Firm*—Young & Thompson

[57] ABSTRACT

The electroless deposition of nickel base alloys is improved by incorporating in the bath ions of vanadium and of at least one of the metals thallium, vanadium, tin, zinc or tungsten. Three of these metals give even better results, and best results are obtained with four or all five. The effect of the plural added metals is synergetic, to improve corrosion resistance, freedom from porosity, and brightness of the deposited coating.

6 Claims, No Drawings

COMPOSITION FOR THE ELECTROLESS DEPOSITION OF NICKEL BASE ALLOYS

The object of the present invention is to provide a composition to be used in the formation of baths for the electroless autocatalytic deposition of nickel base alloys, which can be used for the purpose of increasing the resistance to corrosion of an easily corroded metallic support, and/or to confer a shiny appearance, for the purpose of decoration or finishing, and which is also applicable in processes of metal coating of inert supports which are preventively conditioned according to present technology.

Modern technology requires the use of materials with mechanical characteristics which cannot always be combined with a good resistance to corrosion, and consequently frequently need a covering obtained by deposition of one or more strata of metals or alloys in such a degree as to increase the resistance to corrosion without changing the mechanical characteristics of the support. Often however the overall form of the support renders it inadvisable or impossible to use a galvanic coating process, and in such cases it is necessary to use an electroless process of deposition, in such a manner as to uniformly cover every part of the surface of the support.

Frequently nickel base deposits are required, and in such cases baths are generally used to deposit Ni-P or Ni-B alloys. In order to improve the unsatisfactory quality of resistance to corrosion of these deposits, ternary type alloys have also been used, in other words containing a third component in addition to the two cited; but with this method, as many disadvantages are obtained as advantages.

For example, Italian Pat. No. 927,154 shows that the addition of a certain quantity of copper ions to a solution for the electroless deposition of a nickel-phosphorous or nickel-boron alloy leads to the deposition of an alloy compound of Ni-P-Cu or Ni-B-Cu, having the characteristic of giving the support coating an improved resistance to corrosion, as well as a shiny appearance. However, the quantity of copper present in the alloy is conditioned strictly on external factors such as the bath temperature and the concentration of copper present in solution; thus only shortly after replenishment of the bath is a deposit obtained which has one stratum which is sufficiently rich in copper, and it is thus almost impossible to obtain a deposit of an alloy of uniform and constant composition.

Besides, the use of copper is not advisable since this metal can deposit on the metallic support, or on the coating in the already deposited alloy, by simple chemical displacement. Therefore the formation of a thin stratum of copper is possible, and it prevents the deposition reaction itself, since a solution for the electroless deposition of nickel is not able to deposit autocatalytically on copper, except by use of a galvanic coupling, such as Cu-Fe.

British Pat. No. 1,321,669 discloses a nonelectrically deposited coating of Ni-B or Ni-P alloys which can be improved by adding a thallium base compound to the bath. If the thallium content is restricted to a strictly determined range, a Ni-P-Tl ternary alloy is deposited which is relatively hard, bright and of low porosity. However, it is not possible to improve any single quality without harming the others, and besides it is difficult to maintain the composition of the deposited alloy constant upon replenishment of the bath. And in no case is the improvement of the quality over that of the simple binary alloys truly significant.

The object of the present invention is to make electroless deposits of nickel base alloys possible, which alloy deposits will have superior characteristics of resistance to corrosion, brightness, and absence of porosity, and will present a stable composition, which is little influenced by operating conditions and particularly by additions to the bath, thus avoiding or attenuating the inconveniences which are met in present technology.

The invention proposes a composition to be used in the formation of the baths for the electroless autocatalytic deposition of nickel base alloys, which includes the components of an essentially conventional formulation for the electroless deposition of Ni-P or Ni-B alloys and with the addition of ions of at least two different metals from the group consisting of Groups II B, III A, IV A, V B, VI B of the Periodic System, in which one of these metals is vanadium.

In the preferred form of the invention, three or four salts of different metals from the group indicated above are used, from three or four different groups.

The conventional composition can be any of the compositions used in electroless depositions of Ni-P or Ni-B alloys; it generally contains a nickel salt, a reducing agent, the latter being a hypophosphite or a boron reducing compound, a compounding agent for the metallic ions present in solution, and a pH stabilizing agent, which, with regard to the invention, can be either acidic or basic.

The metals, from groups II B, III A, IV A, V B, VI B of the Periodic System, from among which at least one is selected, constituting with vanadium bases of the additive components according to the invention, are particularly thallium, zinc, tin and tungsten.

These metals can be added to the composition in the form of any organic or inorganic compound containing them, preferably from among those which are water soluble, or can be used directly in the metallic state, being introduced into the solution and being chemically soluble. The method of incorporating the various ions in the bath can thus be entirely conventional.

A bath formulated with a composition according to the invention is such as to deposit a polymetallic alloy on supports such as iron, aluminum, copper, zinc and their alloys, or else on nonmetallic supports which are preventively conditioned according to the teachings of the prior art.

The polymetallic alloy which is thus deposited results from the chemical reduction caused by the reducing agent simultaneously on the nickel, the phosphorous or the boron, and its metals, at least two, added according to the invention. The deposition tends to take place as a homogenous alloy in which the percentages of the various components are in constant ratio with each other, are little influenced by variations of temperature and concentration; consequently the bath can be replenished as needed with additions of reinforcement solutions, without appreciably altering the homogeneity and composition of the deposit.

The deposited polymetallic alloy can have a complex composition, but the various additive metals coact in it in sufficiently reduced quantity so as not to compromise the physical and mechanical characteristics of the deposit, required by different technologies, while some characteristics, such as hardness, ductility, resistance to corrosion, absence of porosity and brightness, are substantially improved with respect to those of the known nickel base electroless deposits, and particularly the Ni-P or Ni-B alloy bases which are obtained according to the prior art.

One advantage of the composition according to the invention is also that with it there is no possibility of deposition by simple chemical displacement of the metals.

Concerning the quantities of the various additive metals, which can be provided in the deposited polymetallic alloy by means of the composition according to the invention, it is to be noted that the total percentage of additive metals must remain between 0.4% and 9%, and preferably between 1.5% and 5%, by weight of the total deposit. More particularly, the percentage of thallium should be within the range of 0.05% to 0.4%; an excess causes in the deposit increased porosity and fragility. The percentage of vanadium should be between 0.05% and 1%; an increase beyond this quantity causes a decrease of the speed of deposition. The percentage of zinc should be between 0.1% and 2.5%; that of tin between 0.1% and 2.1%; that of tungsten between 0.1% and 3%. If the indicated maximum limits are exceeded, the mechanical and especially the hardness and ductility characteristics will deteriorate.

Concerning the minimum indicated limits, the presence of these additive metals in percentages lower than those minima does not involve any inconvenience, but involves also practically no advantageous effect, so that the metals present in percentages lower than the indicated minima can be considered as absent from the polymetallic alloy.

In order to control the useful effect of the application of the concept of the invention, tests have been made of which the results are reported in the following description. These tests have taken into consideration resistance to corrosion, porosity, and the brilliance of the deposits obtained with various compositions.

All of the tests were carried out on deposits on iron plates, subjected to a submersion for a duration of 60 minutes in the aforementioned various solutions for electroless nickel plating, after careful skimming. The electroless depositions were carried out at a temperature of 90° C. and a pH of 5.5.

Concerning the resistance to corrosion, which requires that the deposit be as little soluble as possible in corrosive agents, it was tested according to the accelerated Brown method. In this method, a flat-bottomed flask is filled with concentrated nitric acid at a temperature of 50° C., and the plate being tested is mounted to cover the opening of the flask and left in such position, exposed to the vapors which are generated by the nitric acid, for 15 minutes, then is washed and wiped dry. The comparison of the different samples is effected visually for evaluation of the degree of corrosion on the deposit. The duration of the test, which is normally 50 minutes in the Brown method, was reduced to the aforementioned 15 minutes so as not to cause too much corrosion for visual comparison between the different samples.

Porosity was evaluated by means of another corrosion test, effected on the support instead of on the deposit, by which the resulting corrosion depends on the penetration of the corrosive agent through the deposit, as a function of porosity. An aqueous solution was prepared, containing 3% by weight sodium chloride and 1.5% by volume hydrogen peroxide, dropped on the plate being tested disposed horizontally, and was left to act for 20 minutes. Then the plates were washed and wiped dry and the visual comparison was made of the degree of corrosion on the different samples.

Concerning the brightness of the deposit, it was evaluated comparatively, by visual means, by direct comparison of the plates with those at the end of the electroless deposition process.

The tests were carried out on a certain number of compositions according to the invention, and on comparable compositions, and 11 solutions were used, which have the following characteristics:

Solution No. 1: is a traditional solution according to the prior art, for electroless nickel plating with Ni-P alloy. Its composition is the following:
Nickel—0.09 moles/liter
Hypophosphite—0.20 moles/liter
Glycolic acid—0.40 moles/liter
Ammonium acetate—0.70 moles/liter
Sodium or ammonium hydroxide to reach pH=5.5

Solution No. 2: is solution No. 1 with addition of:
Thallium—0.0001 to 0.0003 moles/liter Solution No. 3: is solution No. 1 with addition of:
Vanadium—0.0003 to 0.0006 moles/liter Solution No. 4: is solution No. 1 with addition of:
Zinc—0.0003 to 0.001 moles/liter Solution No. 5: is solution No. 1 with addition of:
Tin—0.0003 to 0.001 moles/liter Solution No. 6: is solution No. 1 with addition of:
Tungsten—0.0002 to 0.0008 moles/liter.

It is to be noted that solutions No. 2 to No. 6 differ from accepted technology by the addition of one single component, selected from those of which, according to the invention, at least two are to be added to the base composition to assure the desired results. Solutions No. 1 to No. 6 are thus comparative solutions, while the following solutions No. 7 to No. 11 are solutions according to the invention.

Solution No. 7: is solution No. 1 with addition of:
Thallium—0.00015 to 0.00035 moles/liter
Vanadium—0.0001 to 0.0003 moles/liter Solution No. 8: is solution No. 1 with addition of:
Thallium—0.00015 to 0.00035 moles/liter
Vanadium—0.0001 to 0.0003 moles/liter
Zinc—0.0003 to 0.001 moles/liter Solution No. 9: is solution No. 1 with addition of:
Thallium—0.00015 to 0.00035 moles/liter
Vanadium—0.0001 to 0.0003 moles/liter
Zinc—0.0003 to 0.001 moles/liter
Tin—0.0003 to 0.001 moles/liter Solution No. 10: is solution No. 1 with addition of:
Thallium—0.00015 to 0.00035 moles/liter
Vanadium—0.0001 to 0.0003 moles/liter
Zinc—0.0003 to 0.001 moles/liter
Tungsten—0.0002 to 0.0008 moles/liter Solution No. 11: is solution No. 1 with addition of:
Thallium—0.00015 to 0.00035 moles/liter
Vanadium—0.0001 to 0.0003 moles/liter
Zinc—0.0003 to 0.001 moles/liter
Tin—0.0003 to 0.001 moles/liter
Tungsten—0.0002 to 0.0008 moles/liter Solution No. 1 with addition of the components according to the invention should be understood in the sense that the quantity of sodium or ammonium hydroxide has been added after the addition of the other components, in such a manner as to assure attainment of the desired pH value in the final solution.

It is to be noted that solution No. 7 is the minimum solution according to the invention, containing two of the prescribed additive components; solution No. 8 contains three additive components; solutions No. 9 and 10 contain four additive components, and solution No. 11 contains five.

In order to give a numerical expression to the results, arrived at visually, from the tests, for each test there was made a graduated list of the various samples, in order of quality of the results, in other words for the first test (corrosion) and for the second test (porosity) in order of the depth of the corrosion, and for the third test (brightness), in order ranging from more brightness to more opacity, and a number or point is attributed regressively from the best results (11) to the worst (1), standardizing at the highest number the points of the various samples with essentially equivalent results. The sum of the markings of the various tests thus permits expression of a very complex evaluation of the results collected for each sample. The results are collected in the attached table, which gives a qualitative idea of the advantages which can be obtained with use of the invention. In the table, the first column indicates the number of the sample examined, corresponding to the number of the solution used for the nickel plating. The second column indicates the composition of the polymetallic alloy deposited from the solution on the sample. The third, fourth and fifth columns indicate the order in which the samples are found by testing to be, in relation to their resistance to corrosion, to the absence of porosity and to the brightness. The sixth column shows the total evaluation calculated as indicated above.

TABLE

| Sample treated with solution No. | Composition of the deposited alloy | Corrosion resistance | Porosity | Brightness | Overall Evaluation (sum) |
|---|---|---|---|---|---|
| 1 | Ni-P | 1 | 2 | 2 | 5 |
| 2 | Ni-P-Tl | 6 | 1 | 6 | 13 |
| 3 | Ni-P-V | 5 | 4 | 6 | 15 |
| 4 | Ni-P-Zn | 2 | 8 | 4 | 14 |
| 5 | Ni-P-Sn | 4 | 8 | 2 | 14 |
| 6 | Ni-P-W | 4 | 8 | 3 | 15 |
| 7 | Ni-P-Tl-V | 7 | 4 | 7 | 18 |
| 8 | Ni-P-Tl-V-Zn | 9 | 8 | 11 | 28 |
| 9 | Ni-P-Tl-V-Zn-Sn | 9 | 11 | 11 | 31 |
| 10 | Ni-P-Tl-V-Zn-W | 11 | 11 | 11 | 33 |
| 11 | Ni-P-Tl--V-Zn-Sn-W | 11 | 11 | 11 | 33 |

It is to be observed that use of the invention always includes an advantage in general terms with respect to the results obtainable according to present technology, while an opportunity to specifically select the additive metals to be used permits the user to obtain increments of specific quality.

It can be noted for example that thallium and vanadium contribute a special improvement in resistance to corrosion, while zinc, tin and tungsten contribute particularly to the reduction of the porosity. The invention uses present technology to some extent to formulate compositions which are particularly adapted to satisfy any specific requirement for various technical applications.

It will thus be seen that the use of plural additive metals from different ones of the recited groups of the Periodic System, produces an unforeseeable and unobvious synergism.

What is claimed is:

1. In a composition for the electroless deposition of a nickel base alloy containing, in aqueous solution, at least one nickel salt, a hypophosphite or a boron compound reducing agent, at least one compounding agent for the metallic ions present in the solution, and at least one pH stabilizing agent; the improvement in which the composition also contains vanadium ions and ions of at least one metal selected from the group consisting of thallium, zinc, tin and tungsten.

2. A composition as claimed in claim 1, containing vanadium and thallium.

3. A composition as claimed in claim 1, containing vanadium, thallium and zinc.

4. A composition as claimed in claim 1 in which said thallium ions, are present in a concentration of between 0.00005 and 0.001 moles/liter, said vanadium ions are present in a concentration of between 0.00005 and 0.001 mole/liter, said tin ions are present in a concentration of between 0.0001 and 0.005 mole/liter, said zinc ions are present in a concentration of between 0.0001 and 0.005 mole/liter, and said tungsten ions are present in a concentration of between 0.0001 and 0.005 mole/liter.

5. A composition as claimed in claim 1 in which said metal ions are present in a total concentration of between 0.0001 and 0.06 mole/liter.

6. A composition as claimed in claim 5, in which said total concentration is between 0.00025 and 0.0035 mole/liter.

* * * * *